US007343855B2

(12) United States Patent
Schneider et al.

(10) Patent No.: US 7,343,855 B2
(45) Date of Patent: Mar. 18, 2008

(54) OFFSET WATERLESS PRINTING PRESS HAVING A SCREEN ROLLER WITH CERAMIC COATING AND SURFACE MARKINGS

(75) Inventors: Georg Schneider, Wurzburg (DE); Wolfgang Reder, Veitshoechheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 76 days.

(21) Appl. No.: 11/012,236

(22) Filed: Dec. 16, 2004

(65) Prior Publication Data

US 2005/0150405 A1 Jul. 14, 2005

Related U.S. Application Data

(60) Provisional application No. 60/530,926, filed on Dec. 22, 2003.

(30) Foreign Application Priority Data

Dec. 19, 2003 (EP) ..... 03104861

(51) Int. Cl.
*B41F 7/00* (2006.01)
*B41F 31/26* (2006.01)

(52) U.S. Cl. ..... 101/142; 101/350.1; 101/487

(58) Field of Classification Search ..... 101/352–13, 101/487, 349.1, 350.1, 153, 155, 141, 142, 101/491

See application file for complete search history.

(56) References Cited

U.S. PATENT DOCUMENTS 3,098,437 A 7/1963 Tyma, Jr. et al.
3,928,038 A * 12/1975 Bergin ..... 430/301
4,919,047 A * 4/1990 Inouye et al. ..... 101/175
5,778,775 A * 7/1998 Schafer ..... 101/141
5,784,957 A 7/1998 Rau et al.
6,439,116 B1 8/2002 Schafer et al.
6,655,280 B2 * 12/2003 Cartellieri et al. ..... 101/365
6,701,839 B1 * 3/2004 Levy ..... 101/352.13
6,886,461 B2 * 5/2005 Bolza-Schunemann 101/352.06

(Continued)

FOREIGN PATENT DOCUMENTS

DE 195 27 889 A1 1/1997

(Continued)

OTHER PUBLICATIONS

Offsetdrukken: Basisprincipes, vellenoffset, offsetrotatie 5th Edition; Van Hoeflaken W., Sjaak Panse; 1992, Goc Gaade, Amsterdam XP002274271; Seite 164.

(Continued)

*Primary Examiner*—Leslie J. Evanisko
(74) *Attorney, Agent, or Firm*—Jones, Tullar & Cooper, P.C.

(57) ABSTRACT

A rotary printing press has at least one printing group with at least one waterless planographic printing forme. An inking unit is assigned to the printing group as is provided with a screen roller for use in conveying printing ink to the printing group. The screen roller has line engraving or cross-hatchings, with an angle of inclination or an angle of rise of between 50° and 80° and preferably also has a raster frequency of less than 80 lines or cross hatchings per centimeter on its surface area.

21 Claims, 3 Drawing Sheets

U.S. PATENT DOCUMENTS

| | | | | |
|---|---|---|---|---|
| 2003/0172824 | A1* | 9/2003 | Bolza-Schunemann | 101/350.1 |
| 2005/0011387 | A1* | 1/2005 | Schneider et al. | 101/487 |

FOREIGN PATENT DOCUMENTS

| | | | |
|---|---|---|---|
| EP | 1 044 110 | B1 | 10/2000 |
| WO | WO 01/87036 | A2 | 11/2001 |
| WO | WO 03/045694 | A1 | 6/2003 |
| WO | WO 03/045695 | A1 | 6/2003 |

OTHER PUBLICATIONS

"Wasserloser Offsetdruck Alternative Fur Wirtschaftliche, Hochwertige und Umweltvertragliche Druckproduktion," Feb. 16, 1995, Deutscher Drucker, Deutscher Drucker Verlagsgesell-schaft, Ostfildern, De, vol. 31, NR. 7, pp. W06, 8, 10, 12, SP000496336, ISSN: 0012-1096; Seite 8, linke Spalte, Absatz 2; Seite 8, Spalte 3, Absatz A.

* cited by examiner

OFFSET WATERLESS PRINTING PRESS HAVING A SCREEN ROLLER WITH CERAMIC COATING AND SURFACE MARKINGS

CROSS-REFERENCE TO RELATED APPLICATIONS

This U.S. utility patent application claims priority under 35 USC 119 to European Patent Application No. 03 104 861.4, filed Dec. 19, 2003; and to U.S. Provisional Application No. 60/530,926, filed Dec. 22, 2003. The disclosures of those two applications are expressly incorporated herein by reference.

FIELD OF THE INVENTION

The present invention is directed to a printing press with at least one printing group. The printing group has an inking unit assigned to it, which inking unit includes a screen roller. That screen roller conveys printing ink to the printing group and has grooves or cross-hatching on its surface area.

BACKGROUND OF THE INVENTION

A screen roller of an inking unit for a rotary printing press is disclosed in EP 1 044 110 B1 and in U.S. Pat. No. 6,439,116, which is a member of the same patent family. A surface area of the screen roller has endless or helix-like grooves or cross-hatchings which are arranged at an angle of inclination or an angle of rise in a range of between 0° and plus/minus 20°. The raster frequency of these grooves lies between 100 and 400 grooves per centimeter.

Methods are known from WO 03/045694 A1 and from WO 03/045695 A1, in which the tack of a printing ink on a rotating component is maintained substantially constant within a temperature range of 22° C. to 50° C. by heat control of a rotating component of a printing group, which rotating component acts together with the printing ink. The tack of the printing ink is a function of the temperature on the surface area of the rotating component and of the production speed of the latter. Such printing ink is used, in particular, in a printing group for waterless printing, and preferably in a printing group for newspaper printing.

A short inking unit of a rotary printing press is known from WO 01/87036 A2. A screen roller which processes pasty printing ink, in particular printing ink of a viscosity of greater than 9000 mPa*s, is provided. A raster of the screen roller has a ratio of at least 0.5, and in particular greater than 0.8, with respect to a raster of a printing forme on a forme cylinder which is also arranged in the rotary printing press.

The article "Wasserloser Offsetdruck—Alternative für wirtschaftliche, hochwertige und umweltverträgliche Druckproduktion" or Waterless Offset Printing—Alternatives for Efficient, High-quality and Environmentally Friendly Print Production, which appears in the trade journal "Deutscher Drucker," The German Printer, no. 7 of Feb. 16, 1995, pp. W6, 8, 10, 12, discusses that in waterless offset printing special, relatively tacky printing inks are used. Optimal printing results are achieved by a temperature control of inking unit rollers, or by a cooling of the forme cylinder. A constant surface temperature of the printing formes and the rubber blankets is attempted to be maintained.

SUMMARY OF THE INVENTION

The object of the present invention is directed to providing a printing press with at least one printing group, which printing group assures a high quality of resulting printed products, in particular with respect to the color brightness of those printed products. Scumming-free printing must be assured in "dry offset printing."

In accordance with the present invention, this object is attained by the provision of at least one printing group and of an inking unit assigned to the printing group, which inking unit has a screen roller that conveys printing ink to the printing group. The screen roller has grooves or cross-hatchings on its surface. These have an angle of rise or inclination. This angle of rise or of inclination is an angle which the grooves on the cross-hatchings form in a clockwise direction starting at a plane that extends orthogonally with respect to an axis of rotation of the screen roller.

The advantages to be attained by the present invention reside, in particular, in that the properties of the printing ink used and of the ink-carrying parts of the printing press, in particular of the screen roller in an inking unit assigned to the printing group, and of the printing forme arranged on a forme cylinder, are matched to each other in such a way that a satisfactory printing result is obtained by the use of a waterless printing process, particularly in connection with "dry offset printing." It is possible, in this way, to obtain print qualities, particularly in newspaper printing, which print qualities far exceed the quality of conventionally formed printed products, particularly in the area of the brightness of the colors which are attained.

BRIEF DESCRIPTION OF THE DRAWINGS

Preferred embodiments of the present invention are represented in the drawings and will be described in greater detail in what follows.

DESCRIPTION OF THE PREFERRED EMBODIMENTS

Figure 1:
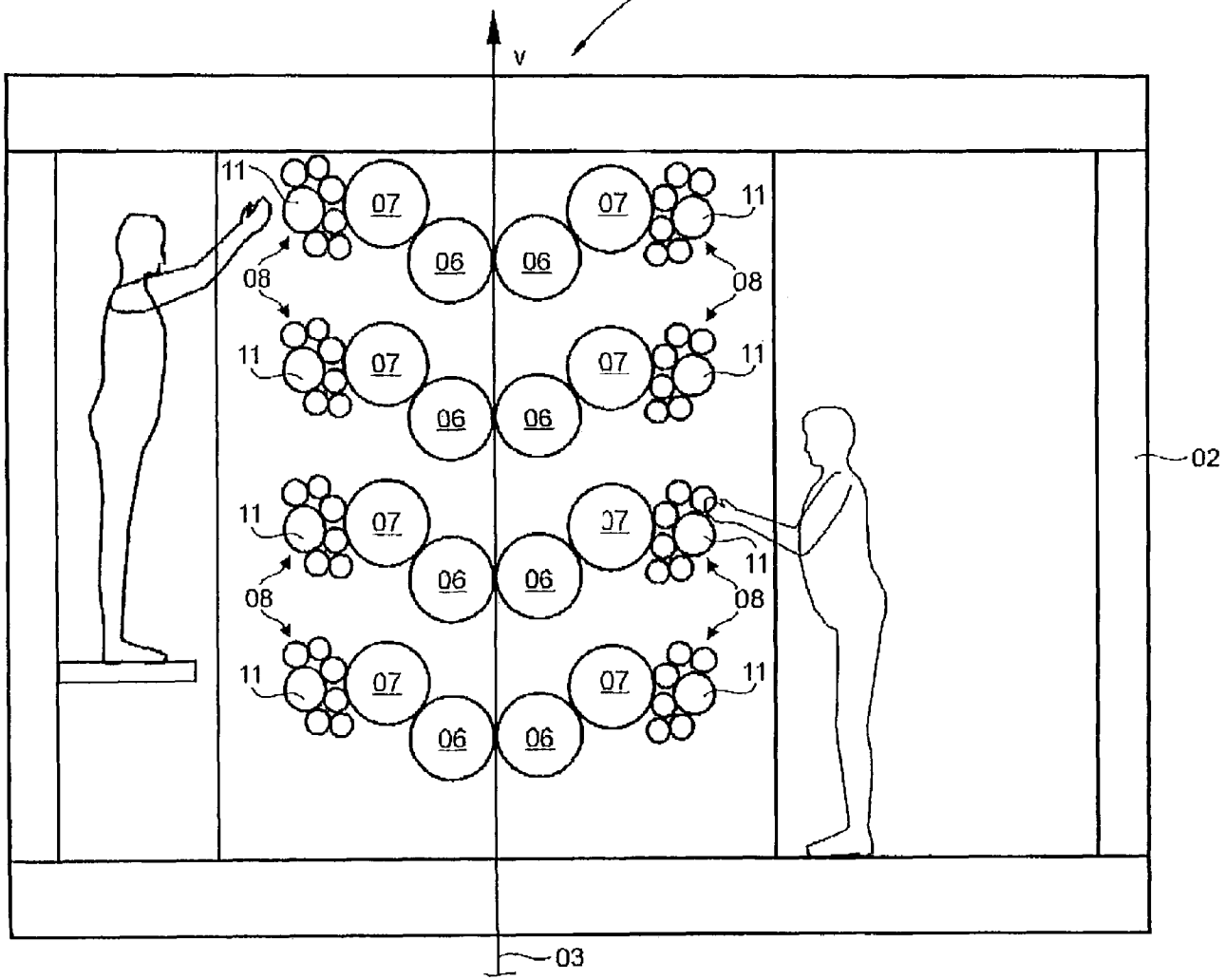
FIG. 1 is a schematic side elevational representation of a printing press suitable for multi-color printing and having four printing units, each with two printing groups.

In a greatly simplified form, FIG. 1 schematically depicts a printing press 01, which may be, for example, a newspaper printing press 01, and which is preferably a printing press using several different printing inks. This printing press 01 may have, for example, four printing units arranged vertically on top of each other in a frame 02. A material 03 to be imprinted, such as, for example, a web 03 of material, particularly a paper web 03, sequentially passes through the printing units in a vertical direction. In this example, a production flow of the material 03 to be imprinted passing through the printing press 01 is assumed to proceed substantially from the bottom to the top of the printing press 01.

Figure 2:
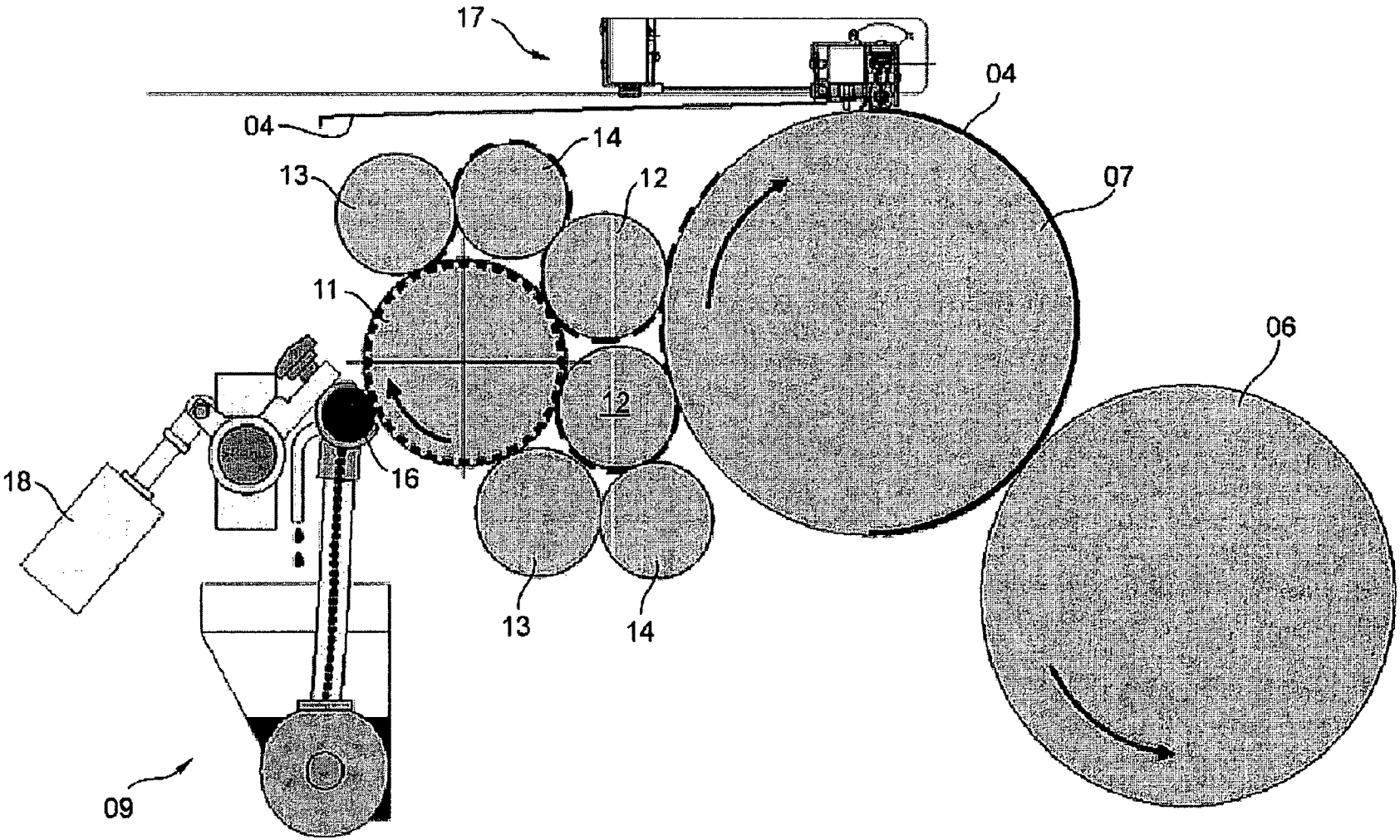
FIG. 2 is a schematic representation of a printing group with one inking unit.

In the schematic depiction of FIG. 1, two printing groups, each with a cylinder 06 transferring printing ink, and a forme cylinder 07 rolling off on the cylinder 06 which is transferring the printing ink, are arranged, in each printing unit, on both sides of the paper web 03 for sheet work printing. An inking unit 08 is assigned to each printing group which group, as discussed above, consists of at least one cylinder 06 for transferring printing ink and one forme cylinder 07. Each inking unit 08 has at least one ink supply 09, as seen in FIG. 2, which may be, for example, an ink fountain 09 or an ink cartridge 09. In a conveying path of the printing ink from the ink supply 09 to the respective forme cylinder 07, a screen roller 11 is positioned and is used for picking up printing ink from the ink supply 09. At least one ink application roller 12 is arranged between the screen roller 11 and the forme cylinder 07. The inking unit 08 can have additional rollers, for example the inking unit 08 can also have at least one inking roller 13 and at least one distribution roller 14. In the embodiment represented in FIGS. 1 and 2, a total of six rollers have been grouped around the screen roller 11. Two ink application rollers 12 have each been placed against the screen roller 11 and the forme cylinder 07. Two inking rollers 13 are provided along the circumference of the screen roller 11. A distribution roller 14, which is not in contact with the screen roller 11, is arranged between each inking roller 13 and a corresponding one of the ink application rollers 12. Additional details of the inking unit 08, in particular the provision of a chamber doctor blade 16 or of a doctor blade cross-piece 16, and with a controllable drive mechanism 18 for use in placing at least one working doctor blade against a surface area of the screen roller 11, can be seen in FIG. 2. Such a working doctor blade is preferably placed against the surface area of the screen roller 11 and works in a direction opposite to the direction of rotation of the screen roller 11. If required, the chamber doctor blade 16 may also have a closing doctor blade that is arranged spaced apart from the working doctor blade in the circumferential direction of the screen roller 11. FIG. 2 also shows a device 17 for feeding a printing forme 04 to the forme cylinder 07. The printing forme 04 can be mounted on the surface area of the forme cylinder 07 in a highly automated manner.

The printing ink is applied to the surface area of the screen roller 11 by the at least one working doctor blade of the chamber doctor blade 16. The cylinders 06 contacting the forme cylinders 07 and transferring the printing ink to the web 03 are preferably configured as transfer cylinders 06 operating in an offset printing process. These transfer cylinders 06 preferably each have an elastic surface, which elastic surface is constituted, for example, by at least one printing blanket made of an elastomeric material and arranged on the surface area of the transfer cylinder 06.

In the preferred embodiment depicted in FIG. 1, the transfer cylinders 06, which are arranged on both sides of the paper web 03, have been placed against each other in a so-called rubber-against-rubber arrangement, so that the transfer cylinders 06, which have been placed against each other, also reciprocally function as counter-pressure cylinders. It is possible, in an alternative construction, to combine the printing groups into a satellite printing unit. In that construction, the printing groups are arranged around a common counter-pressure cylinder which is separate from the remaining cylinders 06, 07, and wherein the paper web 03 being printed is conducted between at least one transfer cylinder 06, that is placed against the counter-pressure cylinder, and the counter-pressure cylinder of the satellite printing unit, which is not specifically depicted.

A further alternative to the depicted configuration of the printing press 01 can provide that the printing press 01 be configured, for example, as a jobbing printing press with a preferably horizontal guidance of the material 03 to be imprinted, preferably on both sides. In such a configuration, printing groups are situated below and above the material 03 to be imprinted, wherein several successive such printing groups are provided in the printing press 01 along the production flow direction of the material 03 to be imprinted as it is passing through the printing press 01. The transfer cylinders 06 of each two opposing ones of such printing groups are again placed against each other, for example in a rubber-against-rubber arrangement. The material 03 to be imprinted is conducted between the two transfer cylinders 06 placed against each other, so that the material 03 to be imprinted passes through their mutual roll-off areas. Alternatively to its being a web 03 of material to be imprinted, the material 03 to be imprinted can also be embodied as a sheet 03.

Figure 3:
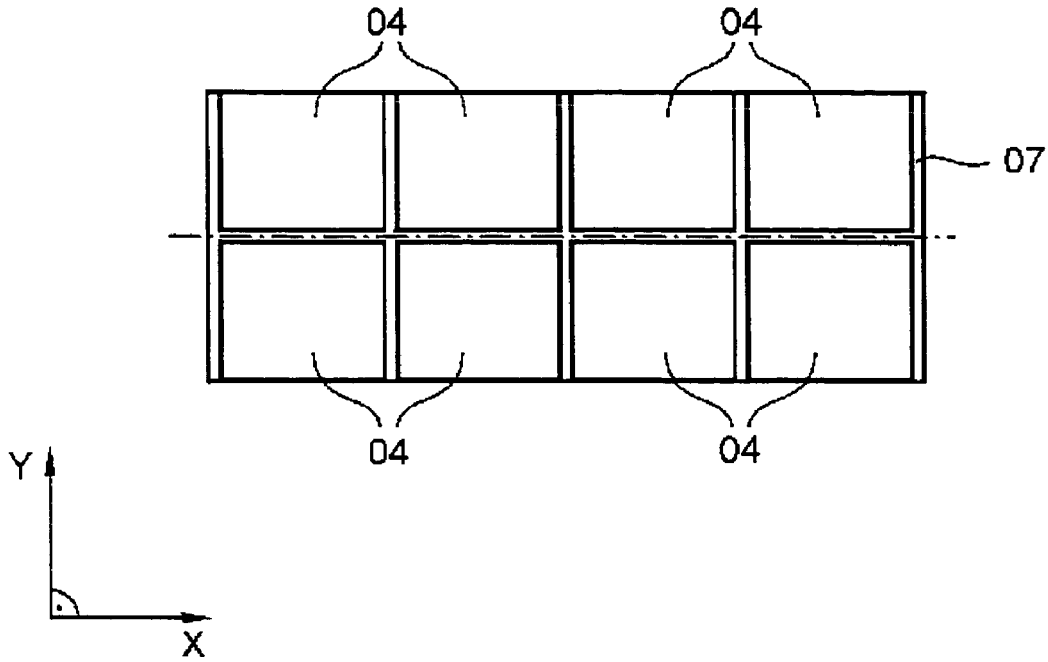
FIG. 3 is a schematic side elevation representation of a forme cylinder with printing formes.

The forme cylinders 07 assigned to the transfer cylinders 06 each have at least one printing forme 04, as depicted schematically in FIG. 2, on their surface area. Each printing forme 04 has been particularly configured as a planographic printing forme 04 that is suitable for use in a waterless planographic printing process or in a so-called "dry offset process," so that a supply of a dampening agent, for use in forming non-printing areas, is not required. The forme cylinders 07 are each preferably covered by several printing formes 04, as depicted in FIG. 3, which are spaced apart in their axial direction X and/or in their circumferential direction Y. For example, in a newspaper printing press, the forme cylinders 04 are each typically covered with four or more printing formes 04 in their axial direction X and with two printing formes 04 in their circumferential direction Y, so that a total of eight of more such printing formes 04 are then arranged on each forme cylinder 07. The roll-off of such a forme cylinder 07, provided with eight such printing formes 04 is schematically represented in FIG. 3. The eight printing formes 04, in the view represented in FIG. 3, are each only half shown. The directional arrows X, Y, which are a part of FIG. 3, and which are arranged at right angles to each other, show the direction X which is axial with respect to the forme cylinder 07 and the direction Y which is circumferential with respect to the forme cylinder 07.

Each printing forme 04 has at least one print image location for imparting a printed image on the material 03 to be imprinted. Each of the printing formes 04 can alternatively have several print image locations in the direction X axially in respect to the forme cylinder 07 and/or in the circumferential direction Y of the forme cylinder 07. Instead of providing, for example, four printing formes 04 on a forme cylinder 07 in its axial direction X, and two printing formes 04, for example, in its circumferential direction Y, each of the forme cylinders 07 can be covered by only a single printing forme 04, for example. This single printing forme 04 may have four print image locations in an axial direction X in respect to the forme cylinder 04, and/or may have, for example, two print image locations in the circumferential direction Y of the forme cylinder 7. Also, each printing forme 04 could only have a single print image location.

The several printing groups which are arranged successively on the same side of the material 03 to be imprinted in the production direction of the material 03 each preferably use printing ink of different shades of colors. For example, color patterns or areas of one of the four color shades black, cyan, magenta and yellow, which are customarily used in connection with four-color printing, will be printed by each printing group. Print image locations, which are correlated with the same print image, are located on the forme cylinders 07 of the successively arranged printing groups, each of which print image locations constitutes a partial color image of the multi-color print image to be created. Each partial color image is assigned to one of the color shades to be printed. A multi-color print image is created since several partial color images which, for example, respectively correspond to the color shades black, cyan, magenta and yellow, are printed on top of each other on the material 03 to be imprinted. The color patterns or areas of the individual partial color images relating to the same print image are arranged next to each other or above each other on the material 03 to be imprinted, so that the multi-color print image is formed by mixing the colors of the color spots resulting from the different partial color images. Print image locations, which represent a partial color image, for use in forming a common print image, must be printed with their respective cylinders 06, which cylinders 06 transfer printing ink from the forme cylinder 07, in an exactly coinciding manner above each other in printing groups which are arranged successively in the production flow of the material 03 to be imprinted.

In waterless offset printing, a silicon layer on the surface area of the printing forme 04, for example, takes on the role of a corresponding hydrophilic area of "wet offset printing," which corresponding hydrophilic area can be covered with a dampening agent in order to prevent the printing forme from taking on color ink in this hydrophilic area. In general, non-printing areas and printing areas of the printing forme 04 are obtained by the formation of these areas with different surface tension in the interaction with the printing ink. For this reason, printing inks are used, in the waterless offset printing process, whose properties differ from printing inks used in conventional "wet offset printing."

To accomplish printing without so-called scumming, i.e. without the deposition of ink on non-printing areas or even without the latter becoming clogged, a printing ink is required whose tack, measured as a tack value, has been adjusted in such a way that a perfect separation can take place between printing and non-printing locations on the printing forme 04 because of the difference in the surface tension. Since the non-printing areas are preferably configured as silicon layers, a printing ink with a clearly increased tack, in comparison to ink used in "wet offset printing," is required for this purpose.

In accordance with the reference book "Der Rollenoffsetdruck" [Web-fed Offset Printing] by Walenski, 1995, tack represents the resistance with which a printing ink counteracts film splitting in a roller gap or in the course of transferring the printing ink between the cylinder 06 transferring such printing ink and the material 03 to be imprinted in the printing zone. The tack of various printing inks, i.e. their tack value, can be determined, for example, in accordance with the standard ISO 12634: 1996 (E). Test arrangements, in particular test arrangements constructed as a roller system, so-called "tack meters," for example the test arrangement "Inkomat" and "Tackomat" of the Prüfaun company of D-82380 Peissenberg-München, Germany, are available for determining the tack value. Tack values depend on the test arrangement used and are put out as dimensionless numerical values. As a rule, producers of printing inks supply the tack value of a printing ink together with the test conditions on which it is based, for example, as a function of which test arrangement the tack value was determined, and at what number of revolutions or what surface speed of the measuring roller. Typical tack value statements refer to a number of revolutions of 400, 800 or 1200 rpm, or to measurements at a surface speed of the measuring roller of approximately 100 meters per minute to 300 meters per minute, and in particular of 200 meters per minute. In the course of being tested, the printing ink is headed to 32° C. and is constantly maintained at this temperature. As a rule, printing inks exhibit increasing tack values with an increase in surface speed.

Since the tack of the printing ink changes with changes in the temperature, the forme cylinder 07 or the inking unit 08 are preferably cooled and/or are maintained at a constant temperature during the operation of the printing press in order to prevent scumming during printing under changing operating conditions.

Besides affecting the separation of printing and non-printing areas, the tack of the printing ink also affects the amount of plucking, in the course of interaction of an ink-conducting transfer cylinder 06 with the material 03 to be imprinted. The danger of the release of fibers and dust caused by such plucking is increased, in particular, if the material 03 to be imprinted is embodied in the form of uncoated, only slightly compressed newsprint of very high absorbency, i.e. newsprint with open pores and with a very short absorption time. This danger also exists in connection with slightly coated or with lightweight, coated paper types used in web-fed offset printing, having a coating weight of, for example, up to 20 g/m$^2$, and in particular of between 5 and 10 g/m$^2$ or even less. This coating weight identifies the amount of coating applied per surface unit to a raw material to be imprinted, in particular to a base paper, i.e. to a paper without a surface coating. As a whole, temperature regulation is especially suitable for use in printing uncoated or coated paper of a coating weight of less than 20 g/m$^2$. Temperature control can be advantageous for coated paper if it has been determined that the coating is at least partially "pulled off" the paper by increased ink tack.

To keep plucking or build-up on the printing blanket carried by the transfer cylinder 06, and on the printing forme 04 as low as possible, an attempt is made to produce and to use a printing ink at the lower limit of tack, if possible, in connection with the printing ink's intended use and with the operating conditions to be expected.

With respect to scumming, or to the clogging of the non-printing areas on the printing forme 04, the relative speed during the detachment process, i.e. during the splitting or the release of the printing ink, plays a decisive role in addition to the tack of the printing ink. At a higher production speed v, depicted in FIG. 1; and which corresponds to the surface, or to the roll-off speed v of the printing cylinder 06, or to the conveying speed of the material 3 to be imprinted, which production speed v is measured, for example, in m/s, the printing ink causes increased tearing forces in the printing gap. Forces also are formed between the ink application roller 12 and the printing forme 04 of the forme cylinder 07, as well as between the printing forme 04 of the forme cylinder 07 and the printing blanket on the transfer cylinder 07. The lower the relative speed, for example the lower the production speed v intended, the higher the tack value of the printing ink must be selected in order to prevent scumming at such low production speeds v. Otherwise, the wrong ink selection leads to poor print quality or, during the start-up procedures, leads to an increased appearance of waste and to a high outlay for maintenance.

If the ink tack increases with an increasing production speed v, a greater amount of plucking on the material 03 to be imprinted occurs as a rule, and an increased build-up of dirt and printing ink on the printing forme 04 also occurs. This results in complications and in increased frequency of maintenance such as, for example, frequent washing of the surfaces, if the tack is one that was initially selected for a lower or for a medium range of the production speed v instead of the increased speed.

The tack value of printing inks used in waterless offset printing lies in a range between 2 and 16, for example. For interference-free printing, the tack value should be attempted to be stabilized at values between 6 and 9.5, for example, and in particular at values between 7 and 8.5. Ideally, the tack value will remain constant within the entire range of the production speed v from 1 m/s to 16 m/s, and within the entire temperature range from 15° C. to 50° C. relevant to the printing process. With a reduction of the tack, increased scumming occurs within the "scumming area," and with an increase of the tack, increased plucking and an increased build-up on the cylinders 06, 07, in an area of "plucking—build-up" occurs. In actual use, a printing ink should be used in "dry offset printing," which ink's tack does not fall below a tack value of 4 or exceed one of 12 over the entire range of production speeds v of 1 m/s to 16 m/s, and in particular the range of 3 m/s to 16 m/s, and/or over the entire temperature range of 15° to 50°, in particular between 22° C. and 40° C. Ideally, the tack value for the range of production speed v of 3 m/s to 16 m/s, or a temperature between 22° C. and 40° C., will lie within a range of 6 to 9.5, and in particular will lie within a range between 7 and 8.5.

The viscosity of the printing ink is also a value of decisive influence on the printing quality. The viscosity of the printing ink is determined, for example, in accordance with the standard ISO 12644: 1996 (E). In accordance with that standard, an ink's viscosity value can be determined by the use of a rod viscosimeter or, for example, by the use of the measuring method in accordance with Höppler, by the use of a drop-ball viscosimeter. Viscosity of a fluid such as ink is a measured value which is greatly dependent on the temperature of the ink. With increasing temperatures, printing inks, in a temperature range of between 15° C. to 50° C., and in particular in a range between 22° C. and 40° C., which range is relevant for the printing process, show a clear drop of their viscosity. For suitable printing inks, the value of the viscosity within the temperature range between 22° C. and 40° C. lies below 350 Pa*s, and in particular will be between 10 Pa*s and 150 Pa*s. Such inks are typically referred to as paste inks or pasty printing inks.

Figure 4:
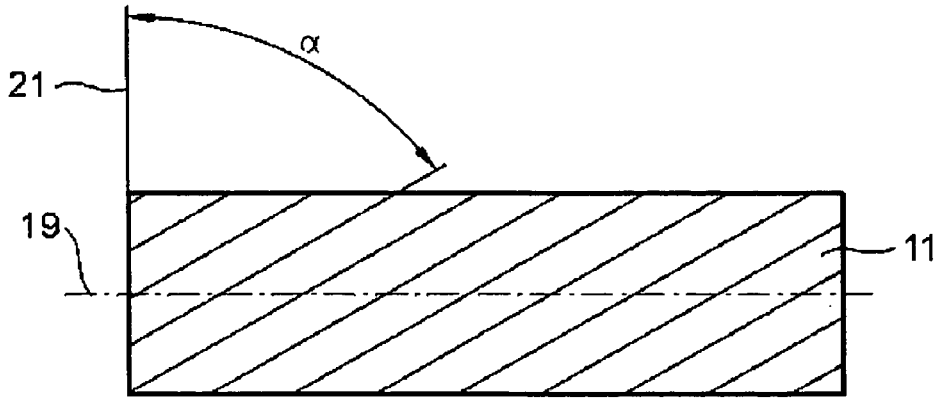
FIG. 4 is a schematic side elevation representation of a screen roller with engraved lines or cross-hatchings in accordance with the present invention.

The surface area of the screen roller 11 must be appropriately configured with surface markings for conveying printing ink. As depicted in FIG. 4, screen roller surface markings, such as line engraving or cross-hatching, with an angle of inclination or an angle of rise $\propto$of between 50° and 80°, and in particular of between 50° and 60°, on the surface area of the screen roller 11 are advantageous. The angle which the line engraving or the cross-hatching forms, with respect to a plane 21 which is orthogonal with respect to an axis of rotation 19 of the screen roller 11, and in a clockwise direction is considered to be, or is defined as the angle of inclination or the angle of rise $\propto$.

In its axial direction X, the screen roller 11 has a raster frequency of, for example, less than 80 lines or cross-hatchings per centimeter, and preferably less than 60 lines or cross-hatchings per centimeter, and in particular has a raster frequency of between 30 and 35 lines or cross-hatchings per centimeter. The surface area of the body, for example the surface area of the steel body of the screen roller 11, is coated, for example, with a ceramic material, which may be, for example, chromium oxide. The radial coating thickness may be between 100 μm and 400 μm, for example. Grooves or cross-hatchings, having a depth of between 20 μm and 200 μm, are cut into this coasting, for example by the use of a laser, such as, for example, a CO2-laser. Accordingly, the lines or cross-hatchings do not penetrate through the thickness of the coating. Instead, a coating thickness of at least between 50 μm and 100 μm, for example, remains between the bottom of the lines or cross-hatchings formed in the coating and the steel body of the screen roller 11. In the cross-sectional view of FIG. 2, the lines or cross-hatchings in the surface area of the screen roller 11 are indicated schematically, and not to scale, by small shallow cups, that are spaced apart from each other, on the circumference of the screen roller 11.

The printing forme 04 used, and in particular the planographic printing forme 04 that is used with the screen roller 11 and with waterless ink, must also be matched to the printing process and/or to the printing ink used. The printing forme 04 also has raster lines, which are not specifically represented, wherein the forme raster lines have a raster frequency of between 50 and 120 lines per centimeter, for example. When intentionally using a low-viscosity printing ink, the printing forme 04 can have raster lines of a raster frequency of between 50 and 70 lines per centimeter, and preferably of 60 lines per centimeter. When intentionally using a printing ink of higher viscosity, the raster lines are configured with a frequency of between 80 and 120 lines per centimeter. The raster frequency of the raster lines on the printing forme 04 and the raster frequency of the lines, or cross-hatchings on the screen roller 11, are matched to each other, and can, for example, also at least approximately correspond.

At least the screen roller 11 is preferably temperature-controlled. It is also advantageous to arrange the printing forme 04 on a temperature-controlled forme cylinder 07. The temperature control of the screen roller 11 and/or of the forme cylinder 07 is preferably accomplished from inside the respective roller or cylinder. For example a flowable temperature-control medium, for example water, may be caused to flow through the screen roller 11 and/or the forme cylinder 07 near their surface areas. The surface area of the screen roller 11 is preferably maintained within a temperature range of between 22° C. and 40° C., for example, and the surface area of the forme cylinder 07 is preferably maintained within a temperature range between 20° C. and 50° C., for example, by use of a suitable temperature control. The screen roller 11 and/or the forme cylinder 07 each have an axial length of, for example, between 500 mm to 1700 mm, in particular of between 1200 mm to 1300 mm.

While a preferred embodiment of a printing press with at least one printing group, in accordance with the present invention, has been set forth fully and completely hereinabove, it will be apparent to one of skill in the art that various changes in, for example, the drives for the cylinders, the printing forme feeding device and the like could be made without departing from the true spirit and scope of the present invention which is accordingly to be limited only by the appended claims.

What is claimed is:

1. A newspaper printing press comprising:

at least one offset printing group adapted to print a material by waterless printing;

a temperature controlled forme cylinder, and a cooperating transfer cylinder in said at least one offset printing group;

at least one waterless planographic printing forme on said forme cylinder in said at least one offset printing group, said at least one waterless planographic printing forme having raster lines of a printing forme raster frequency of between 50 and 120 lines per centimeter;

an inking unit assigned to said at least one offset printing group and including an ink supply;

a paste printing ink said ink supply and having a viscosity between 10 Pa*s and 150 Pa*s at a temperature range of 22° C. to 40° C.;

a screen roller directly contacting said paste printing ink in said ink supply and conveying said paste printing ink to said at least one waterless planographic printing forme of said at least one printing group, said screen roller having an ink receiving screen roller surface and an axis of rotation;

a ceramic coating on said screen roller surface;

a plane extending orthogonally to said screen roller axis of rotation; and a plurality of surface markings on said ceramic coating on said screen roller surface, said surface markings being formed in said ceramic coating, and extending at an angle of inclination in a clockwise direction with respect to said plane, said plurality of surface markings being adapted to pick up said paste printing ink from said paste printing ink supply, said angle of inclination being between 50° and 80°, said plurality of surface markings having a screen raster frequency of no greater than 80 lines per centimeter, said screen roller raster frequency and said at least one waterless planographic printing forme raster frequency being matched to each other.

2. The newspaper printing group of claim 1 wherein each said raster frequency is less than 60 lines per centimeter.

3. The newspaper printing group of claim 1 wherein said raster frequency of said screen roller is between 30 and 35 lines per centimeter.

4. The newspaper printing group of claim 1 wherein said angle of inclination is between 50° and 60°.

5. The newspaper printing group of claim 1 wherein said waterless planographic printing forme raster line frequency is between 50 and 70 lines per centimeter.

6. The newspaper printing group of claim 1 wherein said waterless planographic printing forme raster line frequency is 60 lines per centimeter.

7. The newspaper printing group of claim 1 wherein said waterless planographic printing forme raster line frequency is between 80 and 120 lines per centimeter.

8. The newspaper printing press of claim 1 wherein said forme cylinder is temperature controlled internally.

9. The newspaper printing press of claim 1 wherein said screen roller is temperature controlled internally.

10. The newspaper printing press of claim 1 wherein said forme cylinder is temperature-controlled by a flowable temperature-control medium.

11. The newspaper printing press of claim 1 wherein said screen roller is temperature-controlled by a flowable temperature-control medium.

12. The newspaper printing press of claim 1 wherein the paste printing ink has a tack value between 6 and 9.5 at said temperature range of 22° C. to 40° C.

13. The newspaper printing press of claim 12 wherein said tack value is between 7 and 8.5.

14. The newspaper printing press of claim 1 wherein the paste printing ink has a tack value between 4 and 12 at a production speed of the newspaper printing press between 3 m/s and 6 m/s.

15. The newspaper printing press of claim 1 wherein the paste printing ink has a constant tack value at a temperature range between 22° C. to 40° C. and a printing press production speed between 3 m/s and 6 m/s.

16. The newspaper printing press of claim 1 wherein the printing press is adapted to perform multi-color printing.

17. The newspaper printing press of claim 1 wherein said plurality of surface markings are formed entirely in said ceramic coating.

18. The newspaper printing press of claim 1 wherein said ceramic coating is chromium oxide.

19. The newspaper printing press of claim 1 wherein said plurality of surface markings are laser-cut grooves in said ceramic coating.

20. The newspaper printing press of claim 1 wherein said ceramic coating has a thickness between 100 μm and 400 μm.

21. The newspaper printing press of claim 1 wherein said surface markings on said ceramic coating have a depth of 20 μm to 200 μm.

* * * * *